United States Patent [19]

English et al.

[11] Patent Number: 4,668,204

[45] Date of Patent: May 26, 1987

[54] SINGLE-ENDED HIGH INTENSITY DISCHARGE LAMP AND MANUFACTURE

[75] Inventors: George J. English, Reading; Peter R. Gagnon, Georgetown; Stephen J. Leadvaro, Salem, all of Mass.

[73] Assignee: GTE Products Corporation, Danvers, Mass.

[21] Appl. No.: 889,459

[22] Filed: Jul. 24, 1986

Related U.S. Application Data

[62] Division of Ser. No. 608,310, May 4, 1984, Pat. No. 4,631,446.

[51] Int. Cl.[4] ..... H01J 9/32

[52] U.S. Cl. ..... 445/26; 445/43; 65/42

[58] Field of Search ..... 445/26–27, 445/32, 43; 65/34, 42

[56] References Cited

U.S. PATENT DOCUMENTS

| | | | |
|---|---|---|---|
| 1,680,518 | 8/1928 | Holden . | |
| 2,001,490 | 5/1935 | Gaidies | 176/124 |
| 2,338,336 | 1/1944 | Koch | 65/42 X |
| 2,832,016 | 4/1958 | Bakalar | 65/42 |
| 4,074,167 | 2/1978 | van der Broek et al. | 313/222 |
| 4,469,983 | 9/1984 | Grahmann et al. | 445/27 X |
| 4,557,700 | 12/1985 | Rothwell, Jr. et al. | 445/26 X |

*Primary Examiner*—Kenneth J. Ramsey

*Attorney, Agent, or Firm*—Martha Ann Finnegan; Thomas H. Buffton; José W. Jimenez

[57] ABSTRACT

A single-ended low wattage high intensity discharge lamp and manufacturing process wherein a sleeve of electrical insulating material having the same coefficient of expansion as quartz is telescoped over an electrical lead a fuzed to the "pinch" seal portion of a quartz envelope.

5 Claims, 2 Drawing Figures

SINGLE-ENDED HIGH INTENSITY DISCHARGE LAMP AND MANUFACTURE

This is a divisional application of co-pending application Ser. No. 608,310, filed on May 4, 1984, now U.S. Pat. No. 4,631,446, issued Dec. 23, 1986.

TECHNICAL FIELD

This invention relates to single-ended low wattage high intensity discharge lamps and the manufacture thereof and more particularly to single-ended low wattage high intensity discharge lamps having a relatively high "hot restrike" capability and a process for manufacture of such lamps.

BACKGROUND ART

Generally, high intensity discharge lamps include a pair of spaced electrodes disposed within a sealed envelope and surrounded by a gas which emits light when a discharge takes place between the electrodes. Commonly, the electrodes are embedded in a tube of a material such as quartz and extend through a flattened portion and into an envelope by way of what is usually referred to as a "pinch" seal.

Often such high intensity discharge lamps are of the double-ended construction wherein an electrode is embedded in each one of a pair of tube portions oppositely disposed with respect to a centrally located envelope portion. The envelope portion is formed by a pair of "pinch" seals and each of the electrodes extends through a "pinch" seal into the envelope. However, there are numerous applications where it is much more economical and efficient to provide a single-ended construction wherein a pair of electrical conductors are spaced from one another, embedded in a tube portion and extend through a single "pinch" seal into an envelope having a gas fill therein.

Ordinarily, a discharge between the electrodes is effected by applying a suitable high voltage pulse potential across the electrical conductors which extend into the envelope and serve as electrodes. It has been found that a lamp which has been turned off for a period of time is relatively easy to start since the pressure within the envelope of a relatively cool lamp is usually less than an atmosphere. Thus, a "cold start" voltage of about 2 to 10 KV is not uncommon for a low wattage high intensity discharge lamp. However, it is known that a lamp which has been operational for a period of time has a pressure therein of several atmospheres. Thus, activating a discharge lamp which has recently been turned off requires a relatively high "hot restrike" voltage and voltages in the range of about 35 to 50 KV are not uncommon when energization of a recently operated lamp is desired.

Accordingly, it can readily be understood that problems relating to undesired arcing may be encountered when a single-ended high intensity discharge lamp is subjected to a "hot restrike" voltage after a period of operational use. In other words, a single-ended discharge lamp wherein a pair of electrical conductors are spaced from one another but enter the lamp from the same end are succeptable to undesired arcing, external of the envelope of the lamp, when relatively high "hot restrike" voltages necessary to activate the lamp are employed.

One known attempt to alleviate the above-described undesirable arcing between electrical leads external to the envelope of a high intensity discharge lamp suggests the insertion of an insulator intermediate the electrical conductors. More specifically, the "pinched" end of a glass tube has a pair of spaced electrical conductors embedded therein, a saw cut is made in the tube intermediate the electrical conductors and a piece of mica is inserted into the saw cut of the tube. However, the cutting of a "pinched" tube is not an advisable solution to such a problem because of the tendency for the "sawed" tube to develop undesired and catastrophic crack failures.

OBJECTS AND SUMMARY OF THE INVENTION

An object of the present invention is to obviate the problem of the prior art. Another object of the invention is to provide an improved single-ended high intensity discharge lamp. Still another object of the invention is to provide an improved single-ended high intensity discharge lamp having enhanced resistance to external arcing. A further object of the invention is to provide an improved technique for manufacturing arc-resistant single-ended high intensity discharge lamps.

These and other objects, advantages, and capabilities are achieved in one aspect of the invention by a single-ended low wattage high intensity discharge lamp having a quartz envelope containing a fill gas with a "pinch" seal at one end, a pair of electrical conductors sealed into and passing through the "pinch" seal and a sleeve of electrical insulating material having a coefficient of expansion substantially equal to that of the quartz envelope telescoped over one of the pair (or both) of the electrical conductors and fuzed to the "pinch" seal of the quartz envelope.

In another aspect of the invention, a single-ended low wattage high intensity discharge lamp is fabricated by a process wherein a sleeve of electrical insulating material having the same coefficient of expansion as quartz is telescoped over one of a pair of electrical conductors, the electrical conductors are positioned in spaced relationship within a quartz tube, the quartz tube is "pinch" sealed to embed the electrical conductors, provide an envelope having a portion of the electrical conductors extending therein and fuse the sleeve of electrical insulating material to the quartz tube, a fill gas is introduced into the envelope and the envelope is sealed at the end opposite from the "pinch" seal to provide a high intensity discharge lamp.

BEST MODE FOR CARRYING OUT THE INVENTION

For a better understanding of the present invention, together with other objects, advantages, and capabilities thereof, reference is made to the following disclosure and appended claims in conjunction with the accompanying drawings.

Figure 1:
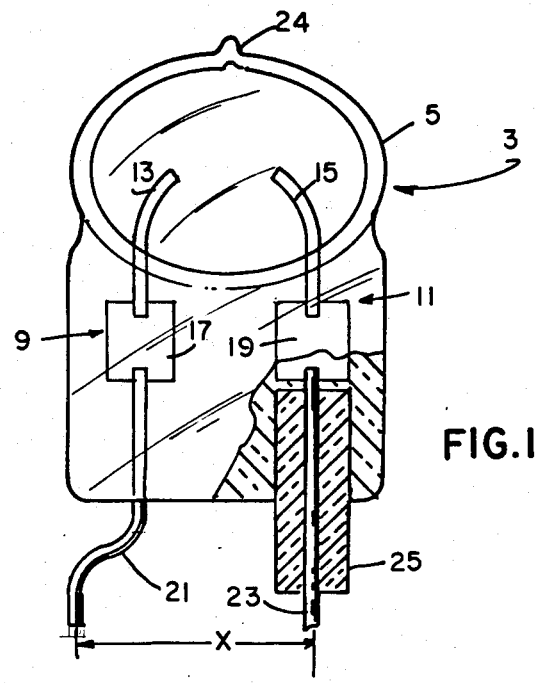
FIG. 1 is a front elevational view, in cross-section of an embodiment of the invention.

Referring to the drawings, FIG. 1 illustrates a single-ended low wattage high intensity discharge lamp 3. The lamp 3 is formed from quartz tubing and is formed to provide an envelope 5 having a "pinch" seal 7 at one end thereof. A pair of electrical conductors 9 and 11 are embedded within the "pinch" seal 7 and spaced from one another, external to the envelope 5, a distance "X" of at least about ¼ inch. Each of the electrical conductors 9 and 11 includes an electrode portion 13 and 15 respectively which extends from the press seal 7 into the envelope 5. Foil members 17 and 19 are attached to the electrode portions 13 and 15 and disposed within the press seal 7 of the quartz tubing. A pair of electrical leads 21 and 23 are attached to the foil members 17 and 19, embedded within the "pinch" seal 7 of the quartz tubing and extend outwardly therefrom to provide for electrical connection of the electrode portions 13 and 15 to an external energization source (not shown).

Importantly, a sleeve of electrical insulating material 25 such as quartz tubing or a material known as Vycor available from the Corning Glass Company of Corning, N.Y. is telescoped over at least one of the pair of electrical conductors 9 and 11 and fuzed into the quartz tubing. Preferably, not necessarily, the electrical insulating material 25 has a wall thickness of about 0.5 mm with an outer diameter in the range of about 1.2 mm.

In particular, the Vycor material or a similar material having substantially the same coefficient of expansion as quartz but a lower working temperature than quartz are preferred materials. Since the fabrication process does not ordinarily permit direct heating of the insulating material 25 but rather depends upon secondary heating thereof through the quartz tubing in order to achieve the desired fusion between the insulator sleeve 25 and the quartz tube, it can readily be seen that a material having a lower working temperature is a desirable insulating material 25.

Additionally, it should also be noted that fusion of the insulating material 25 and the quartz tubing, as compared with a mere mechanical jointure therebetween, is necessary in order to increase the arc over path between the electrical conductors 9 and 11. Moreover, alternate embodiments would include pre-sealing of the insulating material 25 to the electrical lead 23 and then fusing the insulating material 25 to the quartz tubing after the arc tube had been fabricated.

Also, a fill gas such as argon, mercury and one or more metal halides is disposed within the envelope 5 of the high intensity discharge lamp 3. This fill gas is maintained within the envelope 5 by a tipped-off exhaust tube portion 24 located at the end of the envelope 5 opposite from the "pinch" seal 7. Moreover, the fill gas is of a pressure such that a high intensity discharge lamp 3 having a wattage in the range of about 40 to 100-watts has a "cold" start voltage in the range of about 2 to 10 KV and a "hot restrike" voltage in the range of about 5 to 50 KV.

Figure 2:
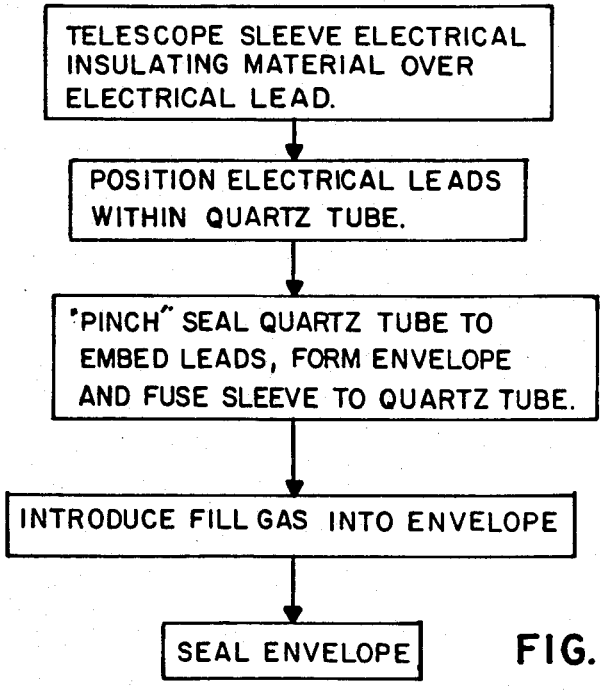
FIG. 2 is a flow chart illustrating a preferred process for fabricating the embodiment of FIG. 1.

As to a preferred process for fabricating the above-described single-ended low wattage high intensity discharge lamp. FIG. 2 illustrates a process wherein a sleeve of electrical insulating material having a coefficient of expansion substantially equal to the coefficient expansion of quartz is telescoped over at least one of a pair of electrical conductors. This pair of electrical conductors is positioned in spaced relationship to one another within a hollow quartz tube. Thereafter, the quartz tube is "pinch" sealed in a manner to embed the pair of spaced electrical conductors therein, form an envelope and fuze the sleeve of electrical insulating material having the same coefficient of expansion as the quartz tube to the quartz tube.

Following a fill gas, such as the previously-mentioned argon, mercury and one or more metal halides, is introduced into the envelope 5. The envelope 5 is then tipped-off to provide a hermetically-sealed container or a high intensity discharge lamp 3.

Thus, a unique high intensity discharge lamp and fabrication process has been provided wherein undesired arcing between electrical conductors external to the lamp envelope has been virtually eliminated or at least greatly reduced. Moreover, this reduced arcing has been effected without hazardous distortion of the "pinch" seal portion of the discharge lamp and at a minimal increase in lamp and component cost.

While there has been shown and described what is at present considered the preferred embodiments of the invention, it will be obvious to those skilled in the art that various changes and modifications may be made therein without departing from the invention as defined by the appended claims.

We claim:

1. A process for fabricating a single-ended low wattage high intensity discharge lamp comprising the steps of:

telescoping a sleeve of electrical insulating material having substantially the same coefficient of expansion as that of quartz over at least one of a pair of electrical conductors;

positioning said pair of electrical conductors in spaced relationship within a hollow quartz tube;

"pinch" sealing said quartz tube to embed said pair of electrical conductors within said quartz tube, provide an envelope having a portion of said pair of spaced electrical conductors extending therein and fuzing said sleeve of electrical insulating material to said quartz tube external of said envelope;

introducing a fill gas into said envelope; and sealing the end of said envelope opposite from said pinch sealed end to provide said high intensity discharge lamp.

2. The process of claim 1 wherein said sleeve of electrical insulating material is in the form of quartz.

3. The process of claim 1 wherein said positioning of said pair of electrical conductors includes the step of locating said pair of electrical conductors at least about ¼-inch from one another external to said envelope.

4. The process of claim 1 wherein said single-ended low wattage high intensity discharge lamp is in the form of a metal halide lamp having a wattage in the range of about 40 to 100-watts.

5. The process of claim 1 wherein said electrical conductors are positioned in the range of at least ¼-inch from one another external of said envelope and said discharge lamp has a "hot restrike" voltage in the range of about 5 to 50 KV.

* * * * *